US008418430B2

(12) United States Patent
Tousek

(10) Patent No.: US 8,418,430 B2
(45) Date of Patent: Apr. 16, 2013

(54) APPARATUS FOR THE MULTIPLE FIXATION OF GOODS ON A PALLET

(75) Inventor: Radek Tousek, Ceske Budejovice (CZ)

(73) Assignee: Jihoceska Univerzita V. Ceskych Budejovicich, Ekonomicka Fakulta, Ceske Budejovice (CZ)

( * ) Notice: Subject to any disclaimer, the term of this patent is extended or adjusted under 35 U.S.C. 154(b) by 321 days.

(21) Appl. No.: 12/877,253

(22) Filed: Sep. 8, 2010

(65) Prior Publication Data

US 2011/0302885 A1 Dec. 15, 2011

(30) Foreign Application Priority Data

Jun. 11, 2010 (CZ) ..... PV 2010-463

(51) Int. Cl.
*B65B 31/00* (2006.01)

(52) U.S. Cl.
USPC ..... 53/432; 53/447; 53/510; 53/556

(58) Field of Classification Search ..... 53/432, 53/434, 447, 510, 512, 556
See application file for complete search history.

(56) References Cited

U.S. PATENT DOCUMENTS

| | | | | |
|---|---|---|---|---|
| 3,429,095 | A * | 2/1969 | Huson | 53/399 |
| 3,508,375 | A * | 4/1970 | Myers | 53/433 |
| 4,562,689 | A * | 1/1986 | Hannen | 53/434 |
| 4,575,989 | A * | 3/1986 | Hannen | 53/434 |
| 5,497,698 | A * | 3/1996 | Bolkestein | 99/476 |
| 5,732,535 | A * | 3/1998 | Mitsuta | 53/512 |
| 2003/0182900 | A1 | 10/2003 | Bowden et al. | |
| 2008/0216450 | A1 | 9/2008 | MacLeod et al. | |
| 2010/0300333 | A1 | 12/2010 | Shepherd | |

FOREIGN PATENT DOCUMENTS

| | | | |
|---|---|---|---|
| GB | 1517521 | A | 7/1978 |
| JP | 55-118381 | A | 9/1980 |
| JP | 55-118391 | A | 9/1980 |
| WO | 2009/053735 | A1 | 4/2009 |

OTHER PUBLICATIONS

International Search Report: mailed Mar. 15, 2011; PCT/CZ2010/000077.

* cited by examiner

*Primary Examiner* — Hemant M Desai
(74) *Attorney, Agent, or Firm* — Ladas & Parry LLP

(57) ABSTRACT

Methods and apparatus for the multiple fixation of goods on a pallet includes the placement of the goods on a basic board, covering of the goods by an air-tight deformable bag, creating a detachable and air-tight connection with the basic board, and exhausting air from the bag by a valve. The free ends of the bag are inserted into a circumferential groove along the perimeter of the basic board prior to exhausting the air, and are fixed in the groove by at least one fixing component. In one example, the fixing component is at least one of a fixing elastic band or a tightening band.

8 Claims, 3 Drawing Sheets

APPARATUS FOR THE MULTIPLE FIXATION OF GOODS ON A PALLET

CROSS REFERENCE TO RELATED APPLICATION

This application is a non-provisional application claiming priority from Czech application no. PV 2010-463 filed Jun. 11, 2010 and incorporated herein by reference in its entirety.

FIELD OF THE DISCLOSURE

The present disclosure relates to the area of packaging and transportation of goods, and more particularly to methods and apparatus for the multiple fixation of goods on a pallet when all components of the equipment can be used repeatedly, and where vacuum packaging is used.

BACKGROUND OF RELATED ART

In the current industrial practice, stretch film is typically used for fixation of goods on pallets. The stretch film is wrapped around the goods after their placement on the pallet and therefore it prevents the undesirable movement of these goods during transportation and storage. One of the major disadvantages of this method is that stretch film cannot be used in this fixing system more than once and after depalletization it becomes waste. For producers, this system of fixing is connected with costs of pallet packaging, for receivers of goods this system of fixing is connected mainly with costs of waste disposal. As an alternative allowing multiple usage, various types of corral pallets have been applied. However, due to their robust design securing the stability of transported and stored goods the ratio of the weight of the transportation means and the ratio of the goods is rather unfavourable.

US patent application US 2008/0216450 proposes a more economical packaging method when plastic foil is inserted between pallet and goods placed on it, the edges of the foil are bent upwards around the wall of the stacked packages with goods. A bag is pulled over the stacked packages holding the edges of the plastic foil tightly. A valve is inserted into the bag to allow for the appropriate adjustment of the pressure inside the package by filling the interior of the package with gas to ensure more durable storage of the packed goods. The equipment is intended for protection of perishables. The disadvantage of this solution is complicated fixation of the plastic foil. In addition, this solution wraps the whole arrangement into a packing foil maintaining thus the burden on the living environment represented by this packing method.

Another US patent application US 2003/0182900 discloses a plastic bag equipped with a valve pulled over the goods stacked on a pallet, the valve increasing the durability of the transported goods. Neither does this solution guarantee that the bag will keep the goods in a fixed position on the pallet and it is therefore necessary to strengthen the packing arrangement by means of a packing foil.

Japanese document JP 55118381 describes a pallet where goods stacked on the pallet are covered by a synthetic resin cover that is fixed to the pallet in an air-tight and detachable way. The pallet is equipped with an exhaust valve for exhausting moist air circulation. This packing arrangement can be used repeatedly, its disadvantage is the storage of empty covers that cannot be collapsed occupying thus a lot of space. Goods under the cover are not fixed at all, which allows them to move, get damaged etc.

BRIEF DESCRIPTION OF DRAWINGS

The invention will be more closely described with respect to drawings, in which.

DETAILED DESCRIPTION

Figure 1:
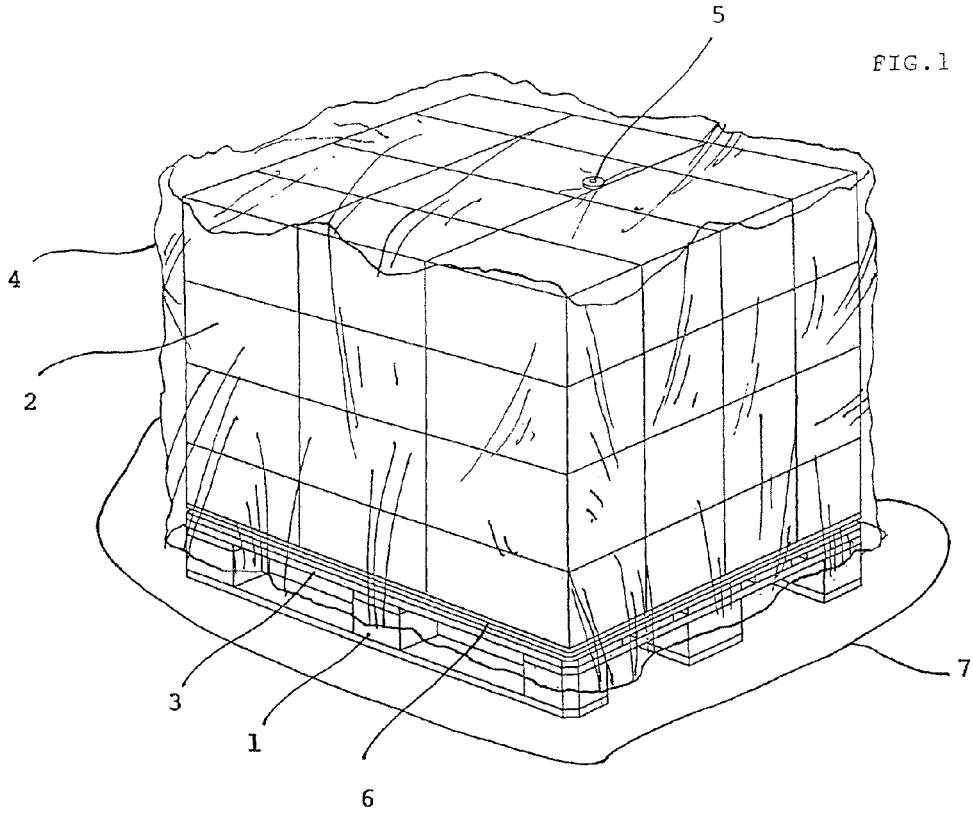
FIG. 1 shows a perspective axonometric view of goods on the pallet with a free-set bag.
Figure 2:
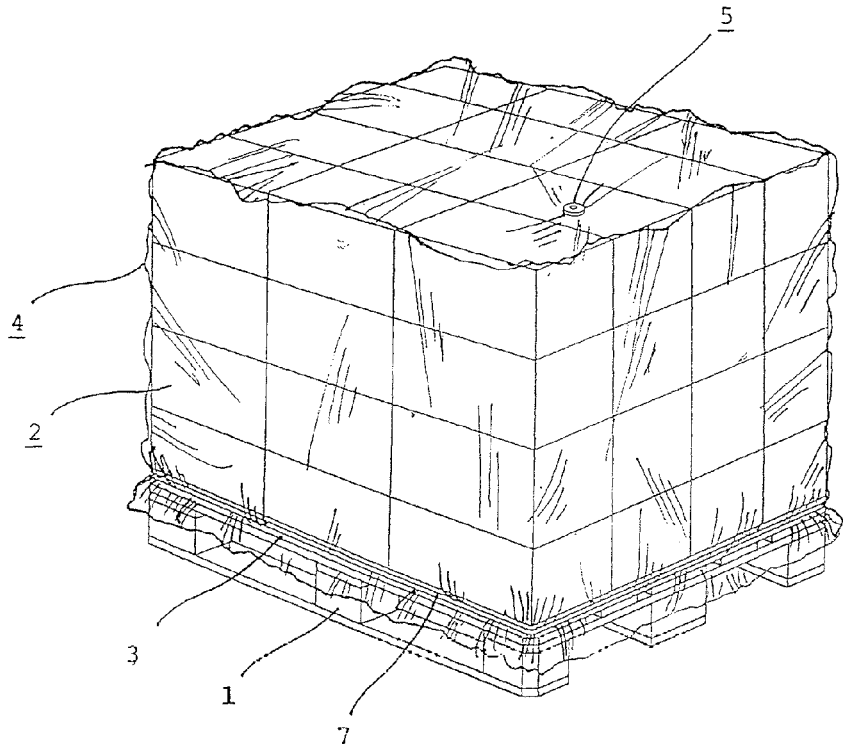
FIG. 2 shows a perspective axonometric view of goods on the pallet with the bag fixed by fixing band after the air was exhausted from the bag.
Figure 3:
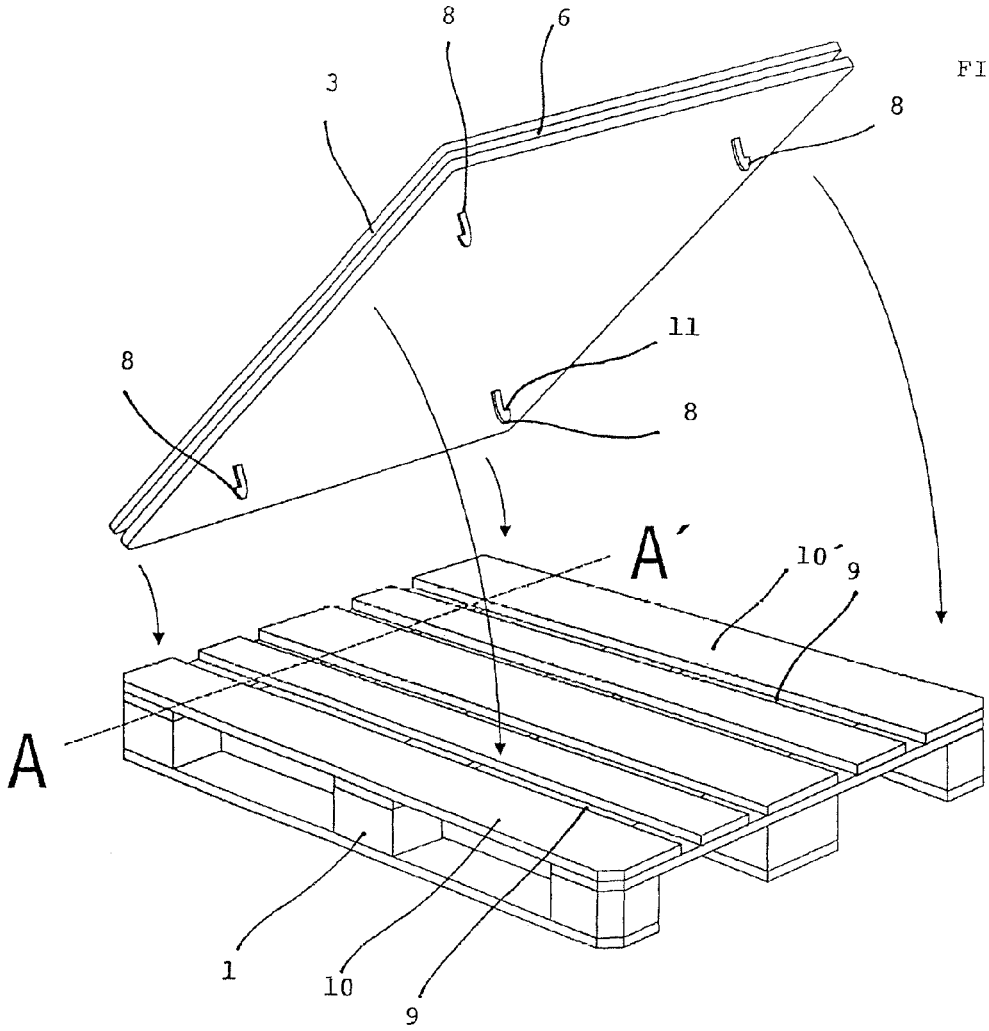
FIG. 3 shows a perspective axonometric view of a the basic board before its fixation to the pallet.
Figure 4:
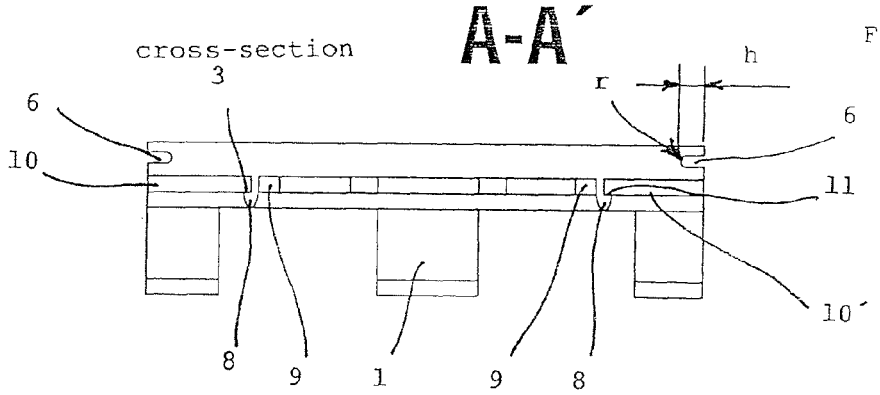
FIG. 4 shows in a cross-sectional view of the pallet fixed to the basic board in the plane A-A' according to FIG. 3.
Figure 5:
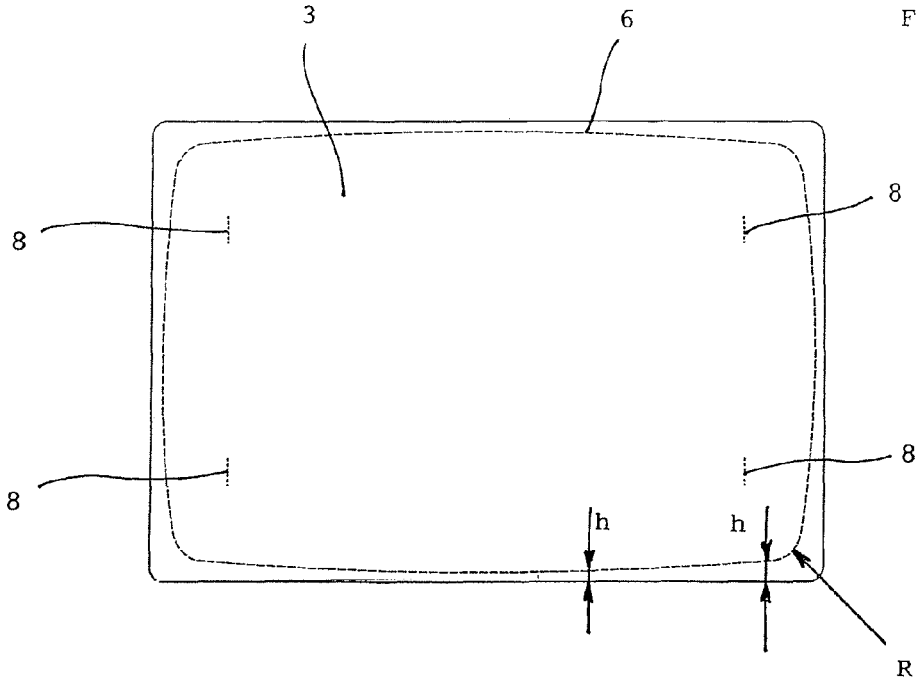
FIG. 5 shows the ground plan of the basic board.
Figure 6:
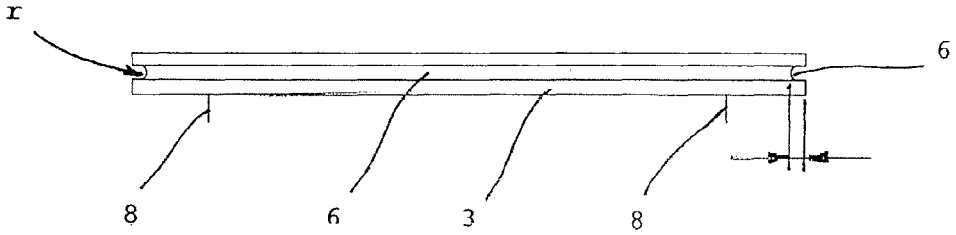
FIG. 6 shows a side view of the basic board.
Figure 7:
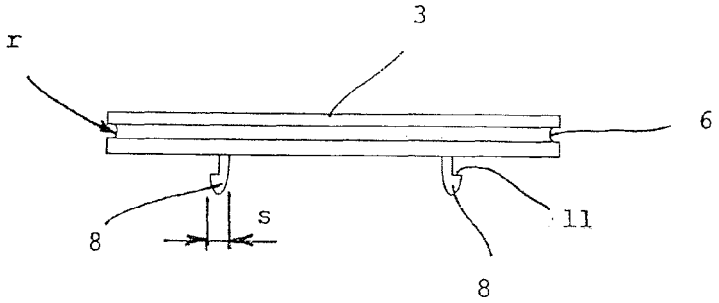
FIG. 7 shows a side view of the basic board.

In one example, the present disclosure aims at creating equipment that could be used repeatedly, that would be economical concerning packing material and that could be easily stored whilst it is not used. The disclosure further concerns the method of use of this equipment. The equipment should also allow an easy and simple assembly and disassembly and reliably fix free-loaded goods, boxes etc. The equipment should be universally applicable for common transportation pallets.

This aim is fulfilled by creation of a method and equipment for multiple fixation of goods on a pallet according to this disclosure.

In one example, the equipment comprises: a basic board, an air-tight deformable bag for goods, creating detachable and air-tight connection with the basic board, and at least one valve for exhausting air from the bag.

In another example, the principle of the disclosure is based on the following procedure: exhausting the air from the bag all free ends thereof are placed in a circumferential groove about the basic board. The free ends are fixed in the groove by at least one fixing component advantageously formed by a fixing elastic band or tightening band.

In yet another example, the principle of the disclosure comprises a basic board being provided with a circumferential groove along whole perimeter of the board. Free ends of the bag are adjusted after being inserted in the groove. The equipment furthermore includes at least one fixing component for fixation of the bag in the groove, arranged at the outside of the bag within the whole perimeter of groove. The fixing component is formed by a band that fits in the groove and creates thus a fixed and air-tight bag enclosure by fixing the bag in the groove.

It is advantageous when the basic board and the bag are of rectangular plan shape that corresponds to the dimensions of classical pallets. Such dimensions allow the application of the equipment on existing wooden and other pallets and the elimination of the need to produce special pallets, but it is also possible to produce, for example, an all-plastic pallet with an integrated basic board. The groove has at corners of the basic board a deeper recess compared to lateral sides in order to lock the fixing component in the groove tighter and deeper because fixation of the package is most stressed at corners. The groove is at all corners provided with a corner fillet therefore there are no sharp edges on the board that could damage the bag, and the fillet allows the bag to fit smoothly without creating any pockets and gaps.

It is furthermore advantageous that the groove has a "U" shape cross-section and its bottom is created with a radius. This shape of the groove is extremely advantageous to fix the fixing component in the groove. The fixing component would slide from another groove profile and thus damaging the fixed and air-tight connection of the board and the bag. Furthermore, the "U" shape can be formed very easily when producing a new board.

According to an example of the present disclosure the basic board forms a separate part fixable to the pallet. It is therefore possible to use the existing pallets for carrying out the method according to this disclosure, mainly wooden EURO pallets that are mostly spread out and it is not necessary to produce special ones. The bottom surface of the board is provided with at least two clamping elements for connecting the basic board with the pallet. The board is therefore tightly but detachably connected with the pallet, which facilitates the manipulation of the pallet without basic boards or with these boards, according to the type of transported goods and their package needs.

According to yet another example, the clamping elements are formed by at least two pairs of contradirectional elastic pawls arranged at mutual distance corresponding to gaps between marginal pallet boards and their neighbouring boards. The clamping elements are provided with a recessing for arresting the pawls behind the edges of marginal boards. The total width of the pawls is smaller or equal to the width of these gaps. Thus a fixed connection between the pallet and the board is created that can be easily detached by pushing away the pawls and removing the basic board. The ends of the pawls are shaped as tips in order to allow the pawls to pass through gaps between the boards more easily and to eliminate small dimensional inaccuracies.

According to still another example of the disclosure the basic board including the pawls is formed as a monolith from plastic matter which is the cheapest and the easiest method of producing basic boards, ensuring at the same time their high solidity.

Finally it is also advantageous that the fixing component is formed by a fixing elastic band or a tightening band that ensures a tight connection of the bag with the basic board, the fixing component being easily available and cheap.

Certain advantages of the equipment for multiple fixation of goods on pallets consist in the possibility to reuse all parts of the equipment repeatedly whereby saving both production costs and the living environment. In addition, particular components of the equipment are easily collapsible and therefore they are not space intensive. Fixation of goods on the pallet protects goods from damage and decreases transportation costs. The equipment is also appropriate for packaging of perishables.

The below described and depicted particular examples are considered illustrative and they in no way limit the invention to the examples herein presented. The below described and depicted particular examples of the various examples are considered illustrative and they in no way limit the invention to the examples herein presented. One of ordinary skill in the art will find or will be able to find more or fewer equivalents to the specific examples disclosed herein in their routine experimental work. These equivalents will also be included in the following claims.

A basic board 3 is placed on a pallet 1, such as, for example, a wooden EURO pallet. The basic board 3 is fixed to the pallet 1 by pawls 8 that are elastic and arranged for their mutual distance to correspond to gaps 9 between marginal boards 10, 10' of the pallet 1 and their neighbouring boards. Each pawl 8 has a recessing 11 that fixes it to the board. The basic board 3 is provided with four pawls 8 and together with them it forms a monolith from plastic matter.

The basic board 3 is of rectangular shape. It is provided with a peripheral groove 6 with a recess h, which is deeper at corners compared to the sides of the basic board 3. The groove 6 is at corners provided with a corner fillet R and it has a "U" shape in cross-section along the whole perimeter and its bottom is created with radius r.

The bag 4 made of a plastic film has a rectangle shaped ground plan with dimensions slightly larger than dimensions of the basic board 3. When packing the bag 4 is pulled over the goods 2 stacked at the basic board 3 that is fixed to the pallet 1 by pawls 8. The bag 4 is fixed to the basic board 3 by means of s fixing component 7, which is a tightening band. The fixing component 7 presses the free ends of the bag 4 into the groove 6 allowing thus the hermetical enclosure of the bag 4 to the basic board 3. Once the bag 4 is tightly fixed, the valve 5 will exhaust the air from it. The valve 5 will be closed up. The goods 2 are therefore tightly fixed on the pallet 1. When removing the goods from the pallet 1 the fixing component 7 will be disconnected and the bag 4 will be removed.

INDUSTRIAL APPLICABILITY

The equipment and the method according to the invention can be applied to multiple fixation of goods on a pallet, bringing along better fixation and prevention of the goods from damage, decrease in storage demands and improvement of storage conditions for perishables.

OVERVIEW OF RELATION FIGURES USED AT DRAWINGS

1 pallet
2 goods
3 basic board
4 bag
5 valve
6 groove
7 fixing component
8 pawl
9 gap
10 marginal board
10' marginal board
11 recessing
R fillet
h recess
r radius
s pawl width

The invention claimed is:

1. An apparatus for multiple fixation of goods on a pallet comprising:

a basic board;

an air-tight deformable bag for the goods, creating a detachable and air-tight connection with the basic board; and at least one valve for exhausting air from the bag wherein the basic board is provided with a circumferential groove along the perimeter of the basic board, wherein the free ends of the bag are dimensioned for insertion in the groove; and at least one fixing component for fixation of the bag in the groove, arranged at the outside of the bag in the whole perimeter of the groove, wherein the basic board forms a separate part fixable to the ballet, and the bottom surface is provided with at least two clamping elements to connect the basic board with the pallet.

2. The apparatus according to claim 1, wherein the basic board as well as the bag have rectangle shaped ground plan and the groove is in corners of the basic board created with a deeper recess compared to its lateral sides, and it is equipped at all corners with a corner fillet.

3. The apparatus according to claim 1, wherein the recess of the groove enlarges gradually and symmetrically from centres of lateral sides of the basic board towards the corners.

4. The apparatus according to claim 1, wherein the groove has a "U" shape at cross-section and its bottom is created with a radius.

5. The apparatus according to claim 1, wherein the clamping elements are formed by at least two pairs of contradirectional elastic pawls arranged at mutual distance corresponding to gaps between marginal boards of the pallet and their neighbouring boards, and are provided with a recessing for arresting the pawls behind the edges of the marginal boards, and the total width of the pawls is smaller or equal to the width of these gaps.

6. The apparatus according to claim 5, wherein the ends of the pawls are shaped as tips.

7. The apparatus according to claim 5, wherein the basic board including the pawls is formed as a monolith made from plastic matter.

8. The apparatus according to claim 1, wherein the fixing component is at least one of a fixing elastic band or a tightening band.

* * * * *